US006114679A

United States Patent [19]

Lai et al.

[11] Patent Number: 6,114,679

[45] Date of Patent: Sep. 5, 2000

[54] MICROWAVE OVEN HEATING ELEMENT HAVING BROKEN LOOPS

[75] Inventors: Lawrence Lai, Mississauga; Neilson Zeng, Toronto, both of Canada

[73] Assignee: Graphic Packaging Corporation, Golden, Colo.

[21] Appl. No.: 09/155,399

[22] PCT Filed: Jan. 29, 1998

[86] PCT No.: PCT/CA98/00047

§ 371 Date: Sep. 29, 1998

§ 102(e) Date: Sep. 29, 1998

[87] PCT Pub. No.: WO98/33724

PCT Pub. Date: Aug. 6, 1998

Related U.S. Application Data

[63] Continuation of application No. 08/790,692, Jan. 29, 1997, abandoned.

[51] Int. Cl.[7] ..... H05B 6/80

[52] U.S. Cl. ..... 219/728; 219/730; 426/107; 426/243; 426/234; 99/DIG. 14

[58] Field of Search ..... 219/728, 729, 219/730, 759; 99/DIG. 14; 426/107, 109, 241, 243, 234

[56] References Cited

U.S. PATENT DOCUMENTS

| | | | |
|---|---|---|---|
| 3,934,106 | 1/1976 | MacMaster et al. | 219/728 |
| 4,990,735 | 2/1991 | Lorenson et al. | 219/728 |
| 5,039,833 | 8/1991 | Woods | 219/730 |
| 5,260,537 | 11/1993 | Beckett | 219/728 |
| 5,593,610 | 1/1997 | Minerich et al. | 219/728 |

*Primary Examiner*—Philip H. Leung
*Attorney, Agent, or Firm*—Dorsey & Whitney LLP

[57] ABSTRACT

A microwave energy heating element has a plurality of spaced microwave components generally arranged in a closed loop pattern. Each of the microwave components (42, 44) has a non-resonant length. When the heating element is in a loaded condition with a load juxtaposed thereto for capacitively coupling the microwave components together, the microwave components cooperatively redistribute impinging microwave energy. When the heating element is in an unloaded condition, the microwave components act independently remaining inert to impinging microwave energy.

24 Claims, 12 Drawing Sheets

RAT CHARACTERISTICS OF THE SOLID RING STRIP

*Based upon Prior Art*

RAT CHARACTERISTICS OF THE SOLID LOOP STRIP WITH SUSCEPTOR FILM

*Based on Prior Art*

RAT CHARACTERISTICS OF THE LONG DOTTED LOOP STRIP

RAT CHARACTERISTICS OF THE LONG DOTTED RING STRIP WITH SUSCEPTOR FILM

TEMPERATURE PROFILE OF THE BASE REFLECTOR WITH SOLID LOOP STRIP

TEMPERATURE PROFILE OF THE BASE REFLECTOR WITH LONG DOT LOOP STRIP

MICROWAVE OVEN HEATING ELEMENT HAVING BROKEN LOOPS

CROSS-REFERENCE TO RELATED APPLICATION

This application is a continuation of U.S. application Ser. No. 08/790,692, filed Jan. 29, 1997, entitled "Microwave Oven Heating Element Having Broken Loops" and now abandoned which is herein incorporated by reference and this application is a 371 of PCT/CA98/00047 filed Jan. 29, 1998.

FIELD OF INVENTION

This invention relates to an improved microwave structure. In particular, this invention relates to a plurality of independent elements which reproduces a full circuit metallic loop element in the presence of food but in absence of food remain independent to eliminate overheating and arcing.

BACKGROUND OF THE INVENTION

Microwave ovens have failed to meet its full cooking potential due to three distinct problems. First, there is the inability to generate uniform temperature distributions within bulk products, due to the finite penetration depth of the microwaves causing heavy perimeter heating with an accompanying electrical quietness in the centre of the product. Second, there is an inability to brown and crisp items in a similar way to conventional ovens caused by the absence of surface power dissipation created by a) the ability of microwaves to penetrate the bulk and b) the low ambient air temperature generally found in a microwave oven. Third, there is an inability to control the relative heating rates of materials as a result of the dielectric properties of the materials becoming the dominant factor in the heating rates, since different materials with different dielectric properties will heat at different rates in the microwave oven and therefore control over multi-component meals becomes lost.

A good deal of work has gone into creating materials or utensils that permit foods to be cooked in a microwave oven and to give outcomes that are similar to a conventional oven's performance. The most popular device being used is a microwave susceptor material. Microwave susceptors are quite effective in generating surface heat and so can contribute significantly to crisping of surfaces. However microwave susceptors do not have any ability to modify the field environment and so their ability to redistribute power within the microwave oven is quite limited.

Other solutions propose the use of metallic structures to redistribute power or to change the nature of the propagation of the microwave power. The basic tenant of how such structures would work is that they should be able to carry large microwave currents within themselves. These structures typically consist of three different features.

First, large continuous sheets of metal may be used to act as a shield protecting the adjacent food materials from exposure to microwaves. Second, resonant elements can be used to enhance bulk heating and to equalize voltages over a fairly large area. In addition, undersized elements that would otherwise be resonant at much higher frequencies can be used to promote evanescent propagation into materials causing a loss of surface power dissipation. Third, metallic elements can be used as transmission components to permit either redistribution of power or the enhanced excitation of localized susceptors.

The effectiveness of metallic structures to change the power distribution in microwaves is based upon the structure's ability to carry microwave currents. In most applications the components that are carrying the currents would be in fairly close proximity to the food, so the food would act as a load in two manners. First, the food would act as a microwave absorbing load, which would dampen the voltages and currents on the various elements. Second, the food would act as a thermal load, acting as a large heatsink ensuring that the substrate or the metallic elements do not overheat.

A serious problem exists for consumer applications. It is impossible to control abuses of the microwave packaging. Examples of such abuses include packages that are incorrectly assembled either at the packaging manufacturer or the food processor, or indeed within the domestic environment. Packages are often damaged during unpacking and display. The cartons in which the microwave packages are shipped are often cut with a blade to open the carton which usually results in several of the microwave packages being cut in the process. The metallic elements designed for intercepting microwave current will generated high voltages across the cut creating a fire hazard.

Consumers may remove all or part of the food load and attempt to cook without the designed food load. The removal of the food load may be as simple as eating half the product and expecting to be able to reheat the other half in the supplied packaging. For many types of metallic elements proposed in the prior art, this removal of the food or any abuse conditions can represent a significant threat to the consumers safety. Removing the food load removes both the electrical and thermal load on the metallic elements. The result may often be that a free standing element when exposed to microwave oven voltages, which for a small load can be in the order of ten to twelve thousand volts per meter for a characteristic microwave oven rated at 900 watts, can stimulate arcing and subsequent fire or heat the substrates to the point where they spontaneously combust. The result is clearly a consumer threat that can either damage the microwave oven or worse, cause personal injury or further damage to components outside the microwave oven if the fire is not contained in a proper manner.

SUMMARY OF THE INVENTION

The disadvantages of the prior art may be overcome by providing a microwave element for redistributing power within a microwave oven which when unloaded will be inert to the microwave energy.

It is desirable to provide a method by which the functionality of an element that is used to redistribute or alter the propogation of power within a microwave oven can be produced in a manner that remains completely safe when unloaded, i.e, when food product is absent.

It is desirable to provide a full circuit metallic element comprising small independent components arranged in a strip-line pattern that remain independent in the absence of a food load but are coupled together in the presence of the food load to restore functionality of the intended full circuit.

It is desirable to provide a microwave heating element which obviates at least one disadvantage of the prior art.

According to one aspect of the invention, there is provided a microwave energy heating element comprising a plurality of spaced microwave components generally arranged in a closed loop pattern. Each of the microwave components has a non-resonant length. When the heating element is in a loaded condition with a load juxtaposed thereto for capacitively coupling the microwave components together, the microwave components cooperatively redistribute impinging microwave energy. When the heating element is in an unloaded condition, the microwave components act independently remaining inert to impinging microwave energy.

According to another aspect of the invention, there is provided a sandwich coupon comprising a substrate and a plurality of spaced microwave components generally arranged in a closed loop pattern thereon. Each of the microwave components has a non-resonant length. When the heating element is in a loaded condition with a load juxtaposed thereto for capacitively coupling the microwave components together, the microwave components cooperatively redistribute impinging microwave energy. When the heating element is in an unloaded condition, the microwave components act independently remaining inert to impinging microwave energy.

According to another aspect of the invention, there is provided a microwave energy heating element comprising a continuous portion having a non-resonant length and a discontinuous portion comprising a plurality of spaced microwave components. Each of the microwave components has a non-resonant length. When the heating element is in a loaded condition with a load for capacitively coupling the continuous portion and the discontinuous portion together, the heating element cooperatively redistributes impinging microwave energy. When in an unloaded condition, the continuous and discontinuous portions act independently remaining inert to impinging microwave energy.

DESCRIPTION OF THE DRAWINGS

Embodiments of the present invention will now be described, by way of example only, with reference to the attached Figures, wherein.

DESCRIPTION OF THE INVENTION

Figure 1:
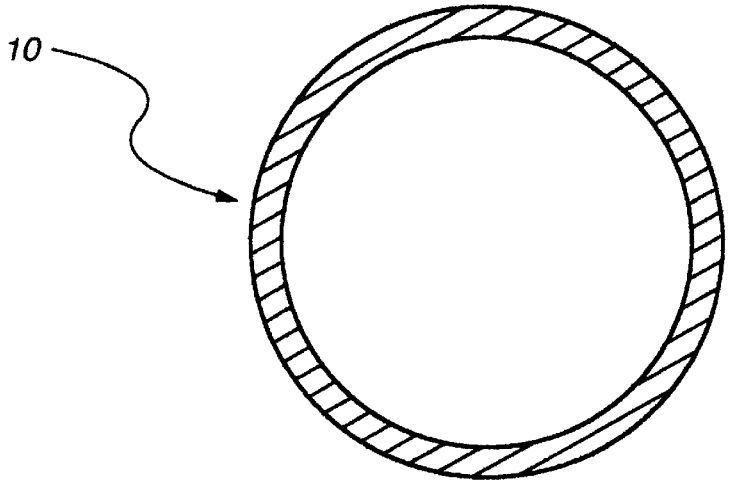
Fig. 1 Prior Art
FIG. 1 is a detailed plan view of a microwave element of the prior art.

The description of the present invention is best illustrated by reference to the prior art. In FIG. 1, a solid loop 10 shown. Loop 10 is an active microwave heating element and may be used for a number of functions. As a large loop, it can stimulate bulk heating and stimulate uniformity in cooking. As a small loop, it can stimulate surface browning and crisping, either in conjunction with a susceptor or without a susceptor. The average diameter and the dielectric environment of the loop 10 will determine its net strength in the currents that are produced in the loop.

The loop 10 is formed of microwave energy interactive material and is applied to a substrate. The loop 10 controls the transmission and impingement of microwave energy upon the food product. The loops 10 is reactive with the incident microwave energy.

Figure 3:
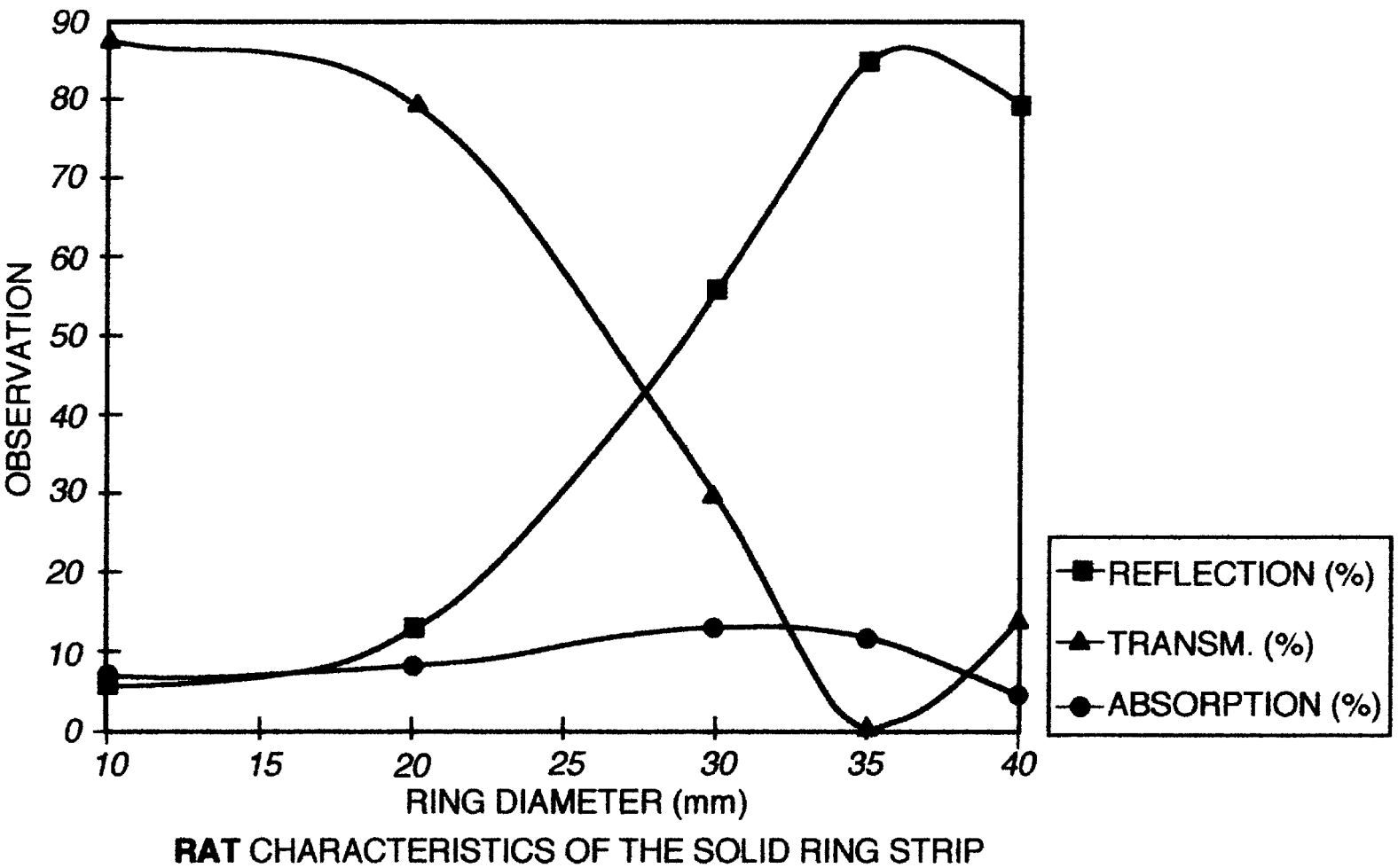
FIG. 3 is a graph of the performance characteristics of the loop of FIG. 1 without a susceptor.

FIG. 3 illustrates the performance characteristics of loop 10 when mounted in a wave guide of type WR430. Loop 10 is very transmissive when it has a small circumferential length. However as the diameter increases to 35 mm, a fairly distinct resonance effect is observed. This resonance effect occurs at 35 mm which gives a calculated one wave length circumference taking into account the mounting of the loop on a paper board substrate. As the scale is increased, the loop 10 would move out of resonance. Had the waveguide permitted larger scales to be used, harmonics would be observed at 70 mm, 105 mm etc. A common use for loop 10 would be for the bottom baking of a pie for example, where the loop 10 would be chosen to be strong and resonant and may in fact be chosen to be operated in conjunction with a susceptor.

Figure 4:
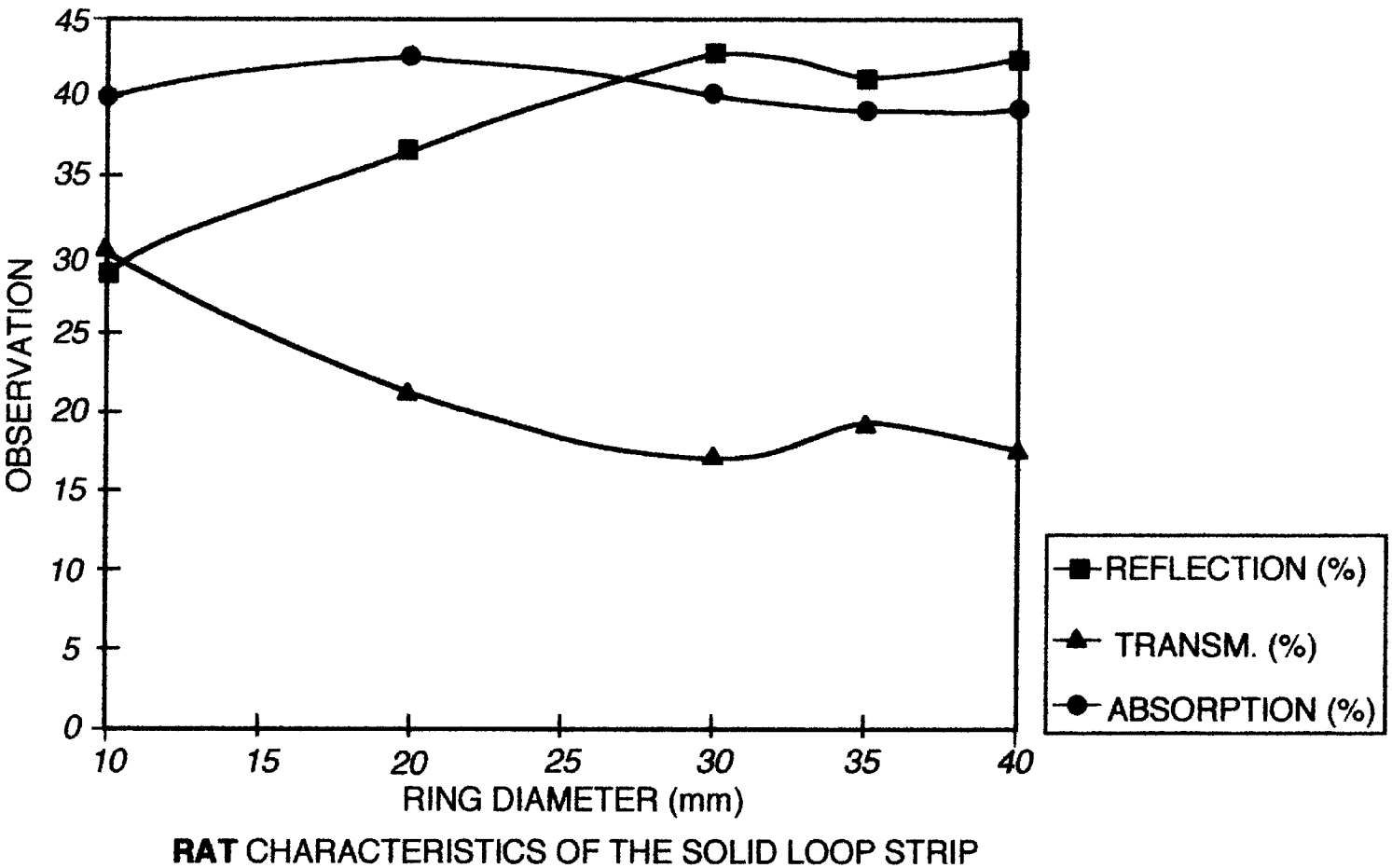
FIG. 4 is a graph of the performance characteristics of the loop of FIG. 1 with a susceptor.

Referring to FIG. 4, the same loop 10 is laminated with a susceptor material. As is illustrated, the same resonance effect is observed. Note however that the Q of the resonance appears to be lower due to the lofty loading of the susceptor material.

In the above examples, the loop 10 would perform very well in conjunction with the food load. However, if the loops are strong (ie resonant or close to resonance) and without a food load they can cause very rapid ignition of many popular substrates (eg paper or paperboard) when exposed to microwave energy in an oven.

Figure 2:
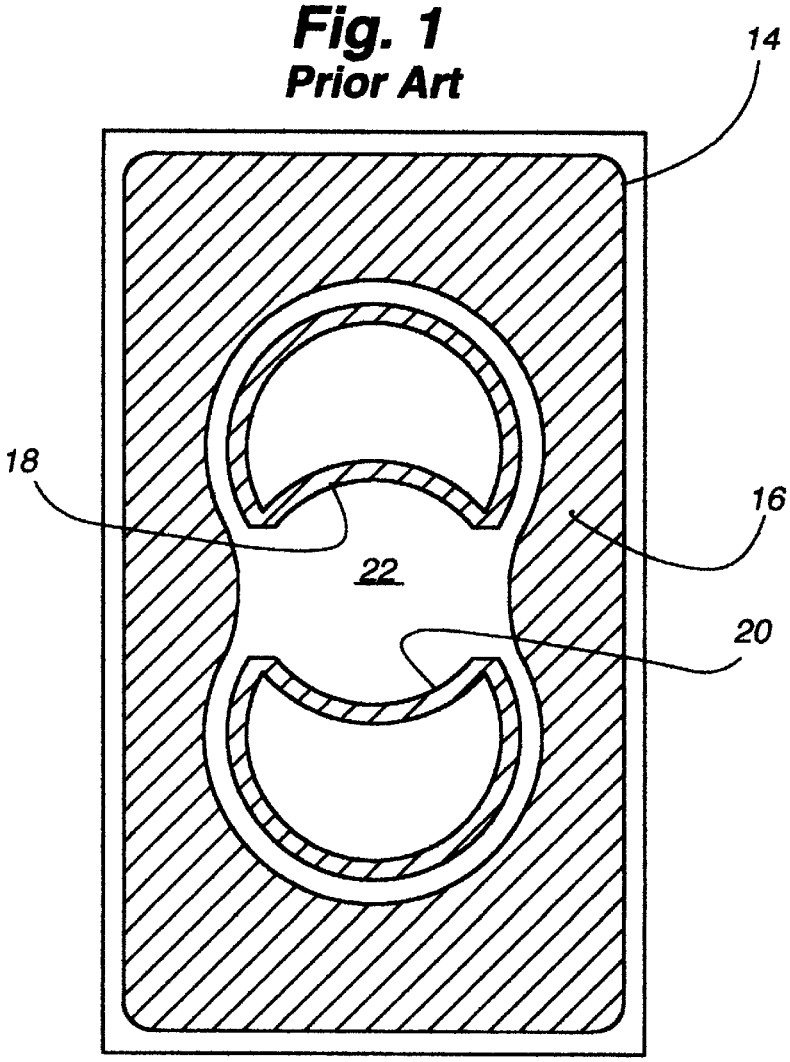
Fig. 2 Prior Art
FIG. 2 is a plan view of a sandwich tray of the prior art.

The sandwich tray design as shown in FIG. 2 consists of a planer paperboard 14 having mounted thereon a plurality of metallic components 16, 18 and 20. The perimeter shield 16 has an aperture 22. Loops 18 and 20 are microwave energy heating elements and are positioned within the aperture 22. The perimeter shield 16 prevents the ends of a juxtaposed food product from over exposure from microwaves and the central aperture 22 with two loops 18 and 20 stimulate even heating.

In the configuration shown, the centre loops 18 and 20 are close to being resonant in the absence of the food load. Exposure of the loops 18 and 20 in an unloaded condition to microwave electric field strengths of the order of 11,000 volts per meter will cause heating of the substrate 14 which causes shrinking and rupturing of the polyester overcoat which exposes the bare foil of elements 16, 18 and 20 which in turn causes arcing, which stimulates combustion of the paperboard. This process takes approximately ten seconds in an 800 to 900 watt microwave oven.

Figure 5:
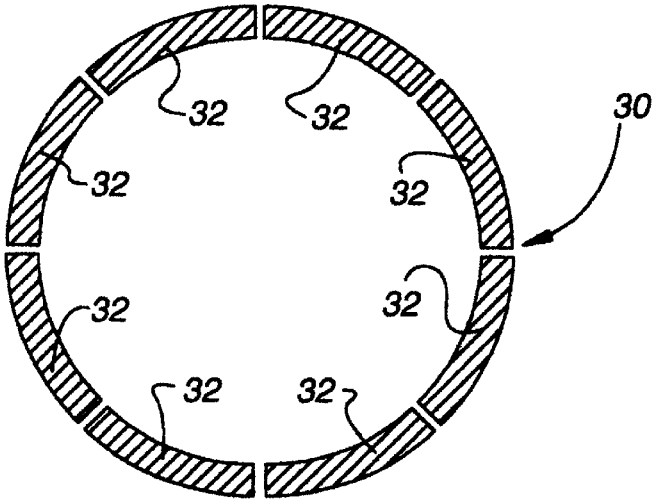
FIG. 5 is a detailed plan view of a microwave element of the present invention.
Figure 7:
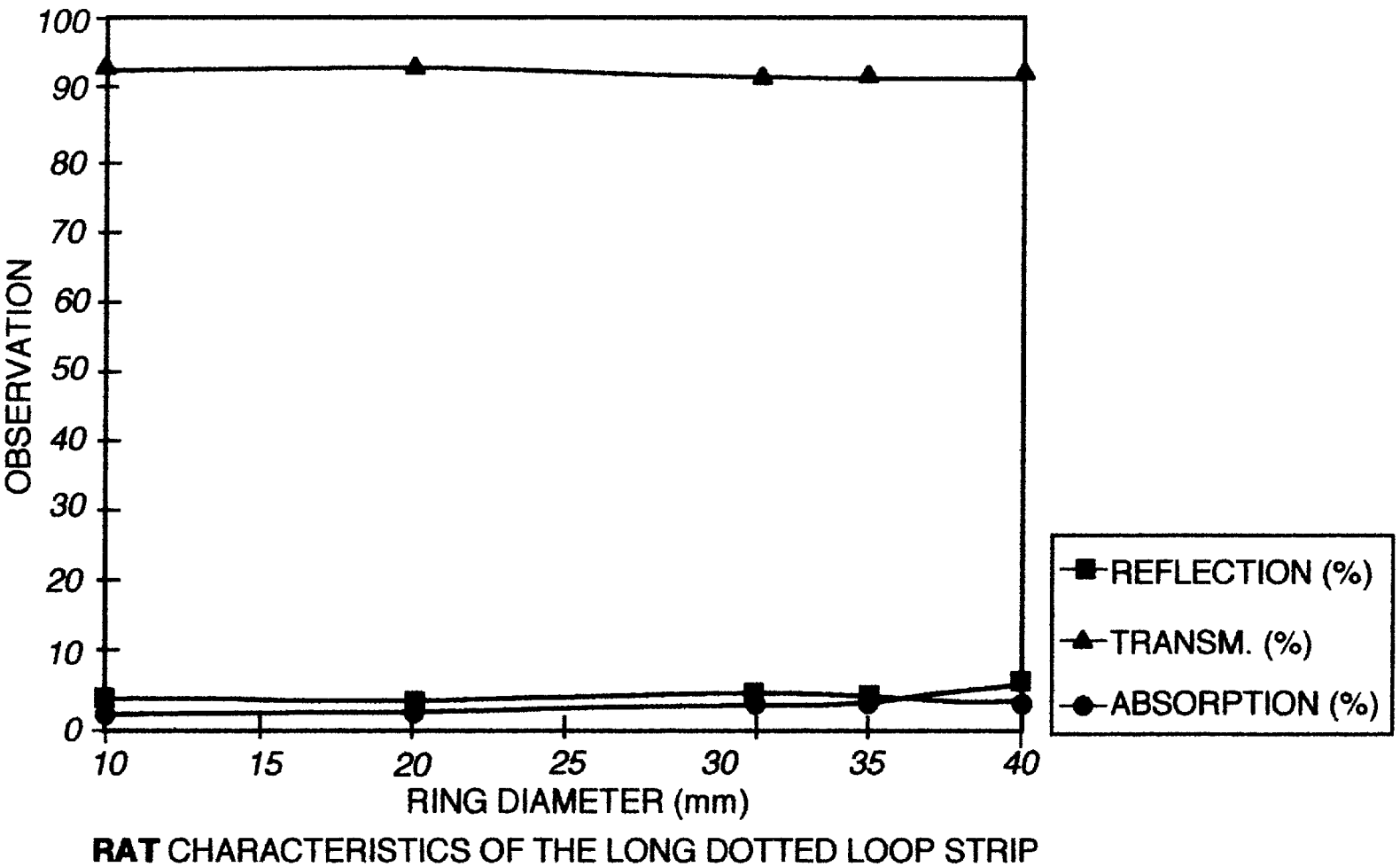
FIG. 7 is a graph of the performance characteristics of the loop of FIG. 5.

The present invention is generally illustrated in FIG. 5. The loop 30 comprises individual components 32 which are spaced apart and arranged in a strip-line pattern. Each component 32 is selected so that its arc length is small enough to be non-resonant to ensure that as a single element each would not cause arcing or ignition of the substrate when unloaded in a microwave oven. This can be observed in FIG. 7 where the loop 32 is scaled up and no resonance effects are observed at a 35 mm diameter. This is because the coupling between the eight segments is low.

Figure 8:
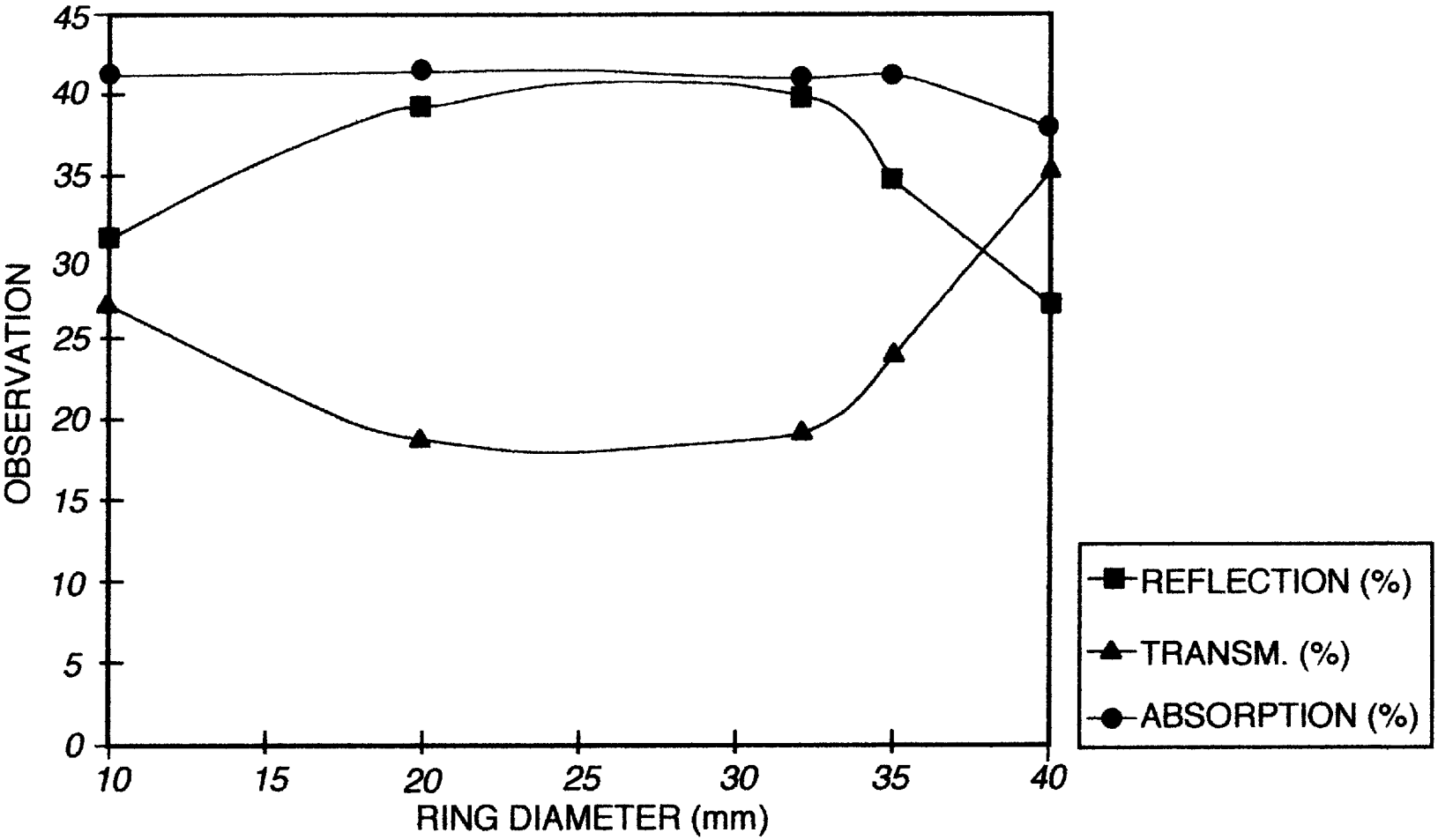
FIG. 8 is a graph of the performance characteristics of the loop of FIG. 5 with a susceptor.

However, when a load with high dielectric constant is adjacent the broken loop 30, the capacitive coupling between the individual segments 32 will cause the loop 30 to appear to be continuous. This is demonstrated in FIG. 8 where the eight segment version of the loop is tested laminated to a susceptor material. The susceptor material provides a quasi joint between each individual segment, as can be seen the low Q resonance effect is observed at 35 mm diameter. The presence of this resonance at 35 mm diameter indicates that the eight segments are acting as a single loop. Had the individual components 32 not been acting as a single loop, then resonance effects would not have been seen until each individual segment 32 of the loop reached a scale such that its perimeter was close to one wavelength. The effectiveness is determined by the capacitive coupling between the individual segments 32. Smaller gaps, wider traces and higher dielectric constant food will enhance the capacitive coupling and hence the loaded effectiveness of the broken loop 30.

Figure 9:
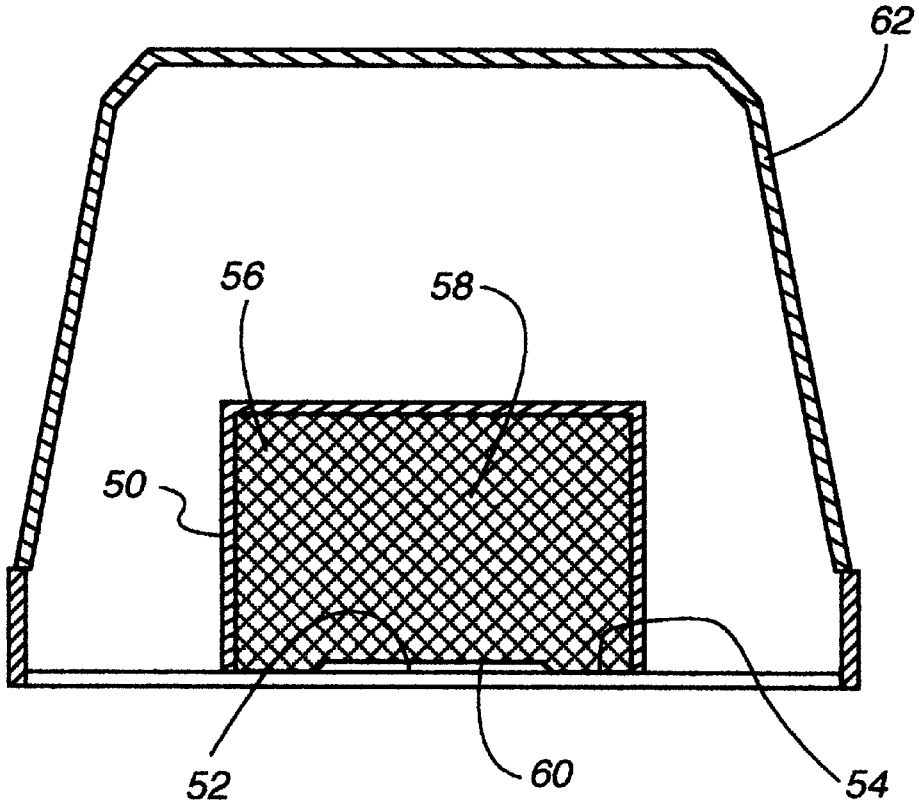
FIG. 9 is a side sectional view of a test apparatus.
Figure 11:
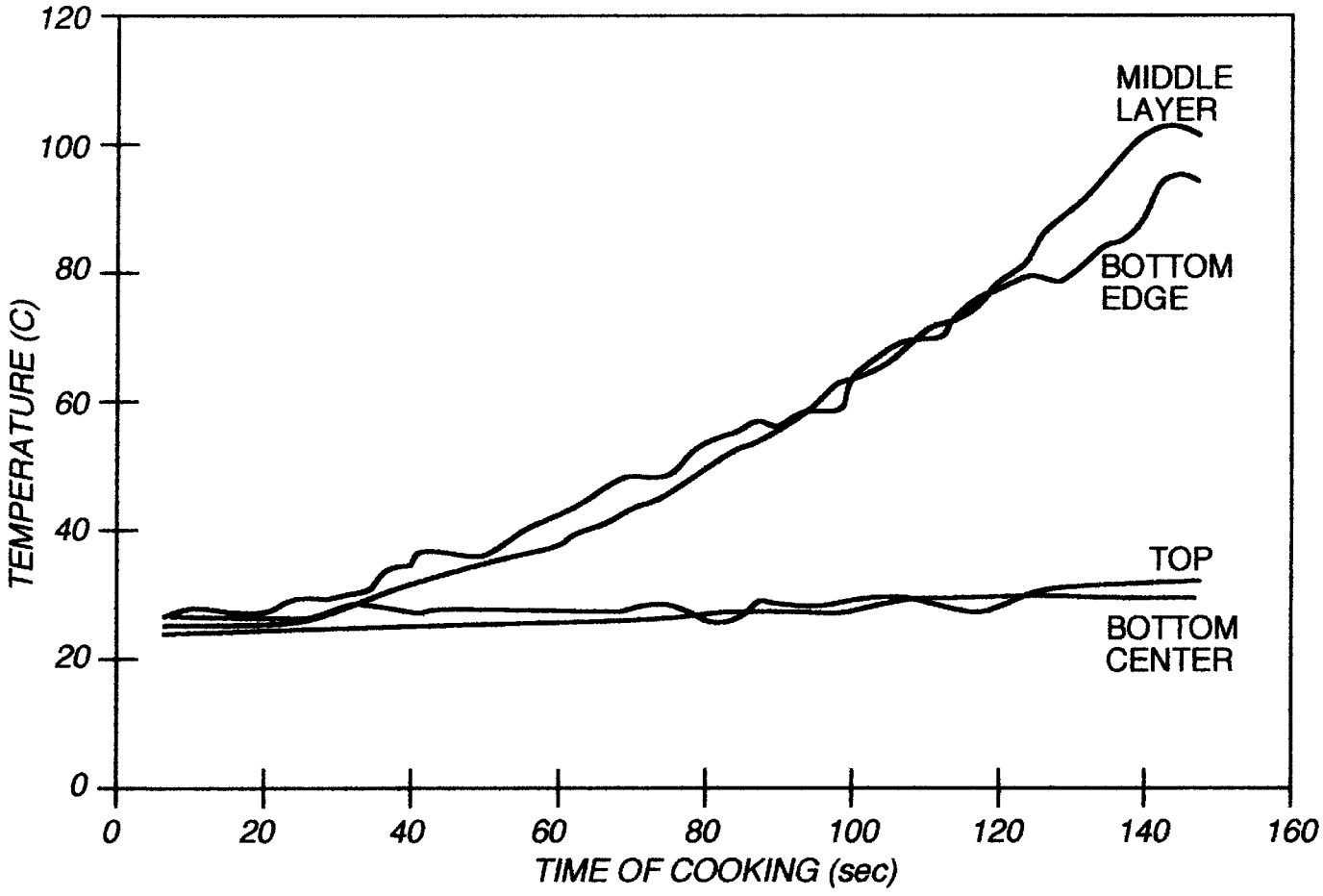
FIG. 11 is a graph of the heating characteristics of the plasticine stack of the test apparatus of FIG. 9, with a sandwich tray with a solid loop.
Figure 12:
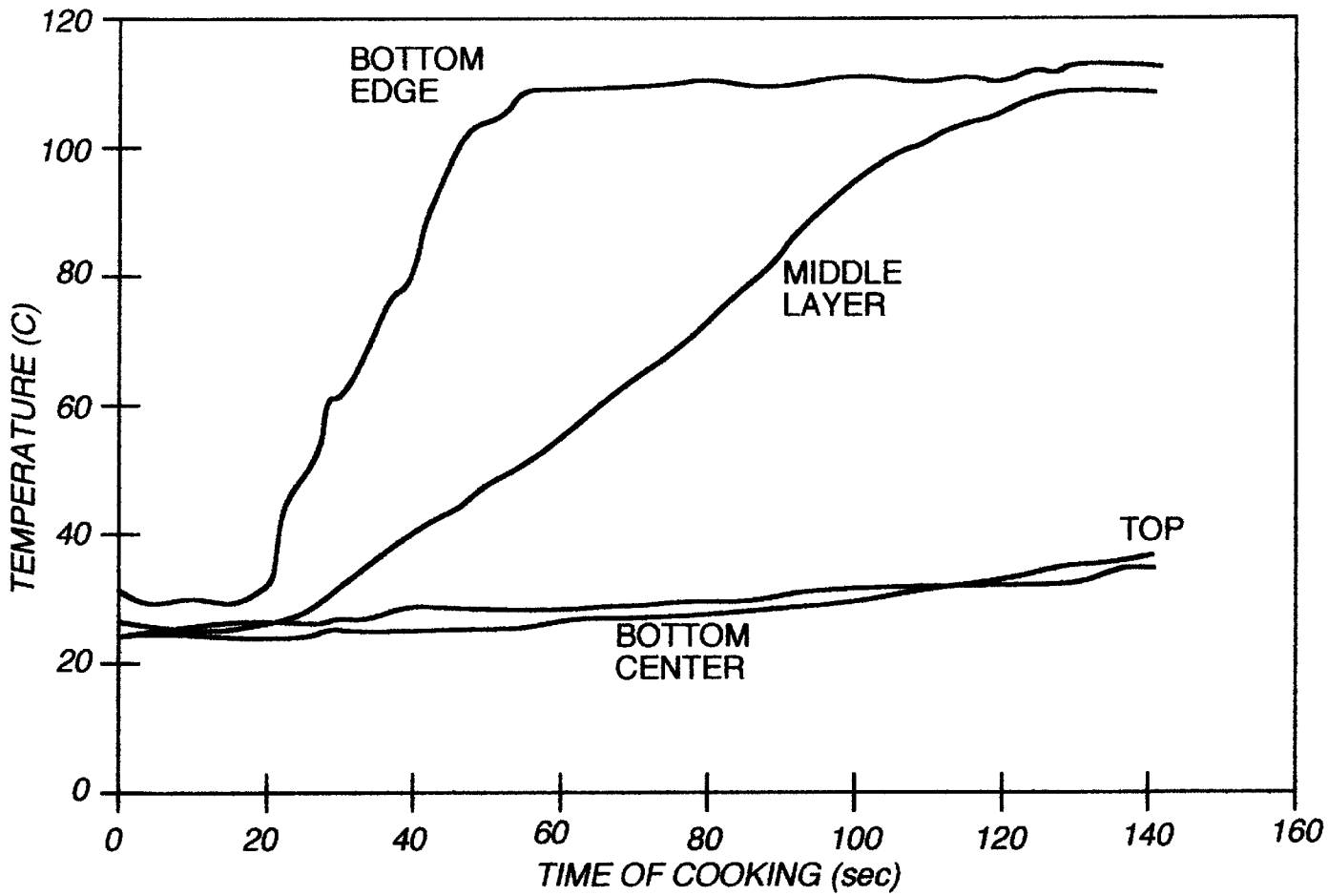
FIG. 12 is a graph of the heating characteristics of the plasticine stack of the test apparatus of FIG. 9, without a sandwich tray with a broken loop of the present invention.

The effectiveness of the individual segments 32 to act as a continuous loop may be demonstrated further with a cooking experiment, as illustrated in FIG. 9. In a cooking experiment four individual disks of water based plasticine with a dielectric constant of 5.0 placed on top of each other forming a stack 50. Four fluoroptic temperature probes 52, 54, 56 and 58 were placed at positions within the plasticine stack 50 and the plasticine stack 50 was mounted on top of the test loops 60. The plasticine stack 50 was then protected from microwave exposure from the top and the sides by placing a fully shielded cap 62 over the plasticine. The test set-up and results of cooking the plasticine with a; no loop, b; a solid loop and c; the dotted equivalent loop are shown in FIGS. 10, 11 and 12, respectively.

Figure 10:
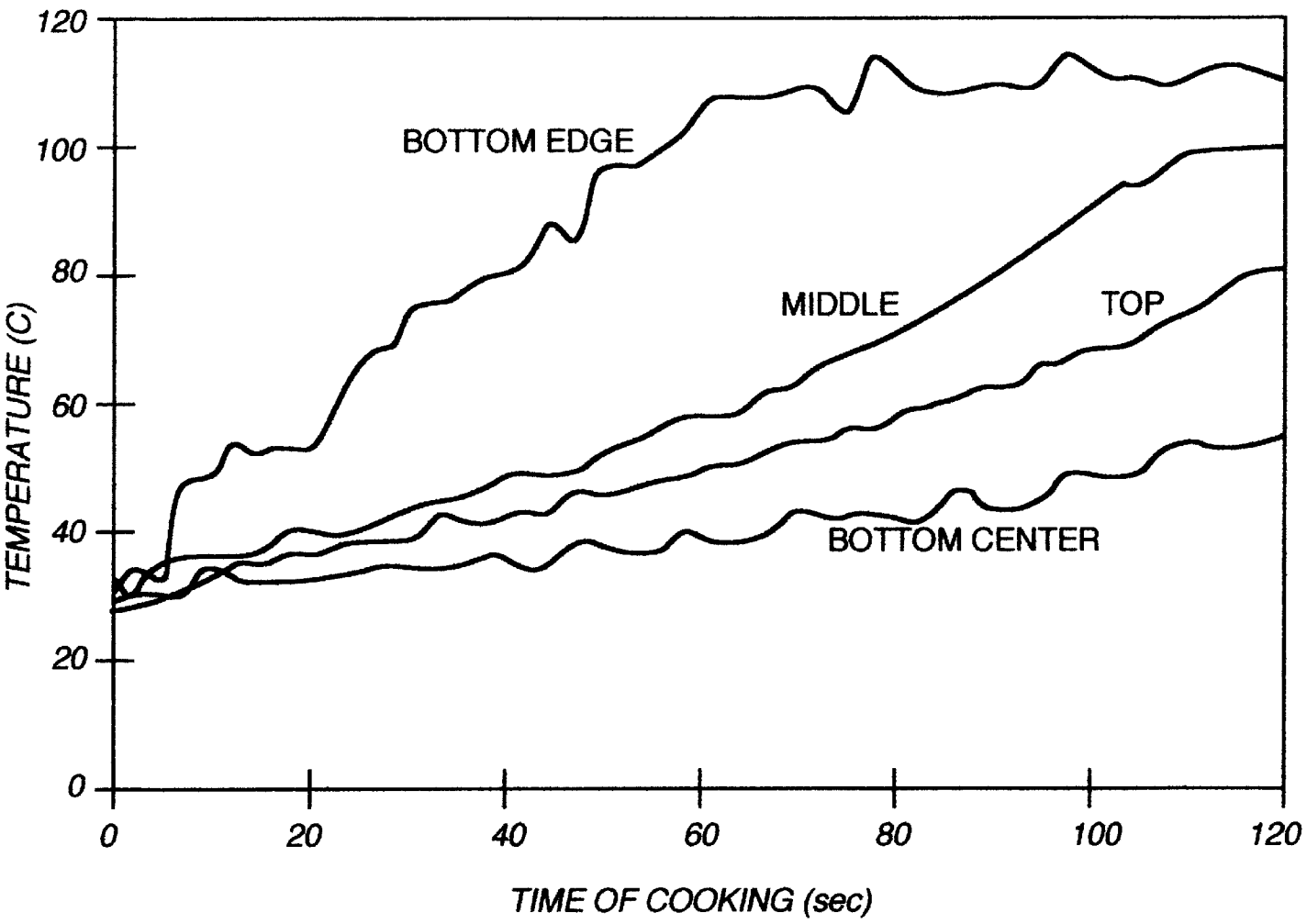
FIG. 10 is a graph of the heating characteristics of the plasticine stack of the test apparatus of FIG. 9, without a sandwich tray.

As can be seen in FIG. 10 without a loop present, the relative heating rates through the four layers of plasticine were fairly predictable. The heating rate dropping exponentially as a function of thickness. As illustrated in FIG. 11, the solid loop stimulates a loss of surface heating at the expense of the heating of the top and middle layers of the plasticine stack 50. In a very similar fashion as illustrated in FIG. 12, the dotted loop of the present invention behaves in the same way.

Figure 6:
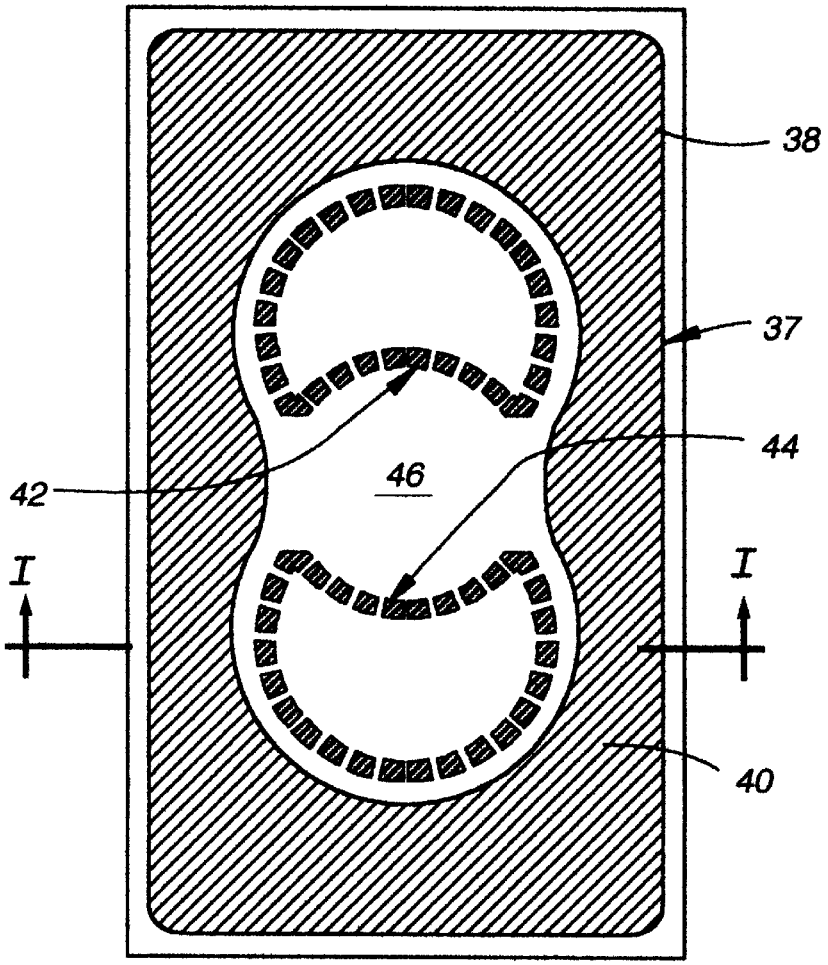
FIG. 6 is a plan view of a sandwich coupon incorporating the microwave element of the present invention.
Figure 17:
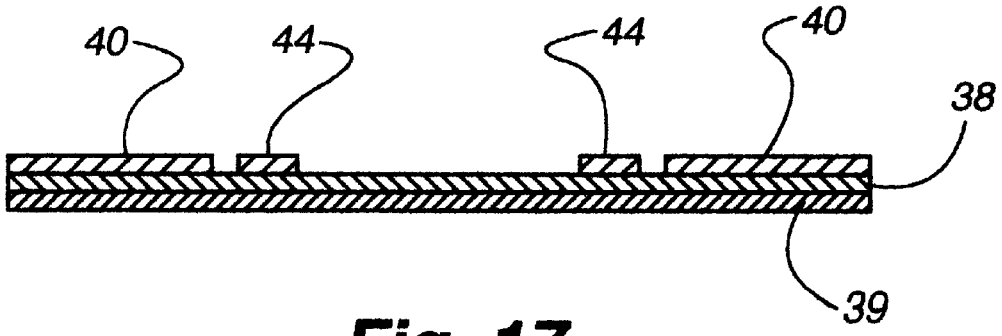
FIG. 17 is a sectional view of the sandwich coupon of FIG. 6 along the lines I—I.

The sandwich tray 37 as shown in FIGS. 6 and 17 consists of a planer substrate 38 having mounted thereon metallic elements 40, 42 and 44. Substrate 38 is formed of suitable material such polymeric film, paper or paperboard. The perimeter shield 40 has an aperture 46. Broken loops 42 and 44 are comprised of individual components and positioned within the aperture. The perimeter shield 40 prevents the ends of the sandwich from over exposure from microwaves and the central aperture 46 with two broken loops 42 and 44 stimulate even heating.

The sandwich coupons of the present invention are preferably produced by selective demetalization of aluminized or aluminum laminated polymeric film wherein the aluminum is of foil thickness, using an aqueous etchant, such as aqueous sodium hydroxide solution. Procedures for effecting such demetalization are described in U.S. Pat. Nos. 4,398,994, 4,552,614, 5,310,976, 5,266,386 and 5,340,436, assigned to the assignee hereof, and the disclosures of which are incorporated herein by reference.

In use, the sandwich coupon 37 is juxtaposed with a sandwich. The size of the tray is such that the tray will cover one face of the sandwich. The sandwich and tray are then wrapped in microwave transparent wrapping. The consumer will place the wrapped sandwich and tray in a conventional microwave oven and cook for a predetermined amount of time.

The sectioned or broken loops 42 and 44 generate equivalent even heating performance as for a continuous loop illustrated in FIG. 12, using an equivalent food product in. However when the broken loops 42 and 44 are in an unloaded condition and exposed to as much as 20,000 volts per meter, there is virtually no fire risk.

The broken structure or loops of the present invention can have several formats. In general, greater functionality can be achieved by having as high a voltage as can be tolerated in the unloaded condition on each individual segment. This ensures maximum capacitive coupling between segments. Furthermore, the nature of the adjacent surfaces can be altered to maximize the capacitive coupling therebetween. Examples of other embodiments are shown in FIGS. 13 and 14.

Figure 13:
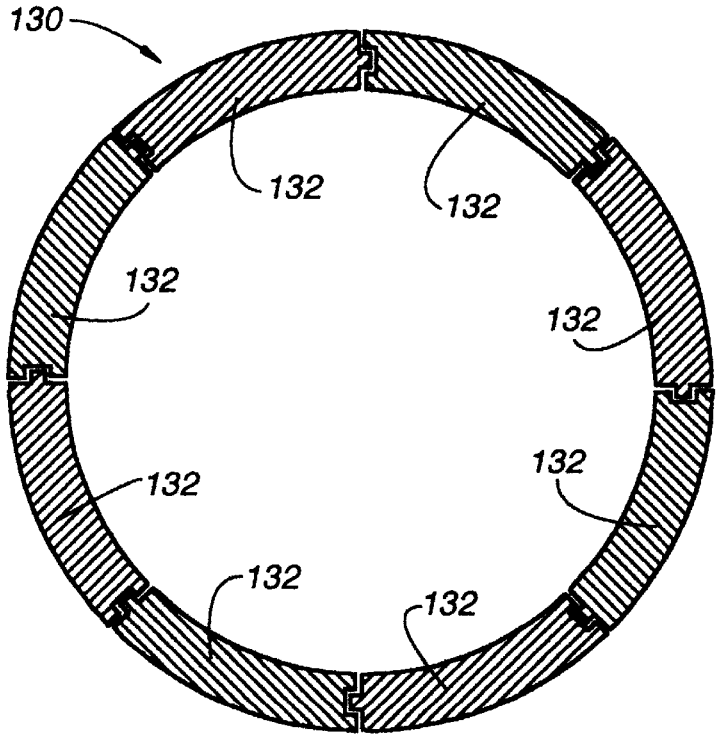
FIG. 13 is a top plan view of a second embodiment of the broken loop of the present invention.
Figure 13A:
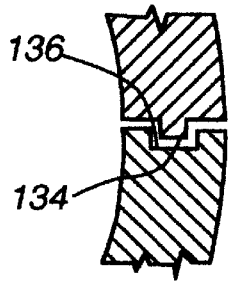
FIG. 13A is a sectional view of a section of the broken loop of the present invention.

As shown in FIG. 13 and FIG. 13A each of the microwave components 132 of the loop 130 have a tab 134 at one end and a slot 136 at the opposite end. The tab 134 and the slot 136 are sized such that the tab 134 fits within the slot 136 in a spaced tongue and groove manner.

Figure 14:
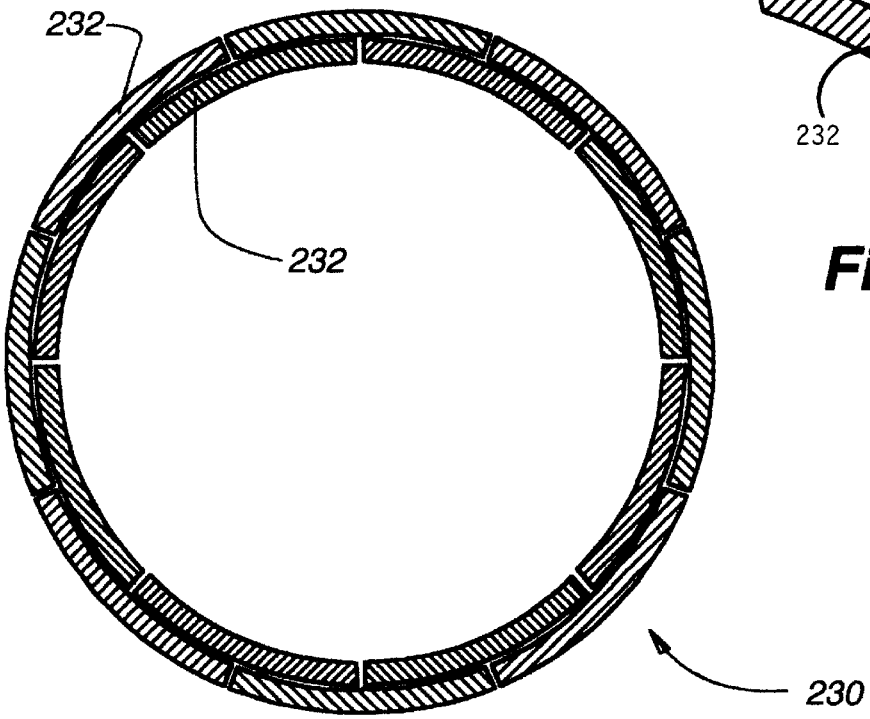
FIG. 14 is a top plan view of a third embodiment of the broken loop of the present invention.
Figure 14A:
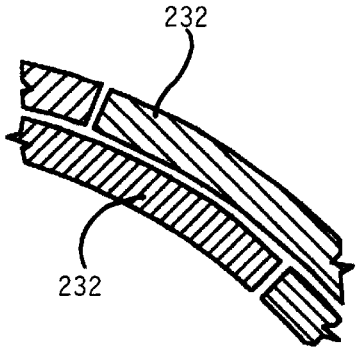
FIG. 14A is a sectional view of a section of the broken loop of the present invention.

As shown in FIG. 14 and FIG. 14A the loop 230 comprises an inner and outer ring of spaced microwave components 232. The inner ring is staggered relative to the outer ring.

Figure 15:
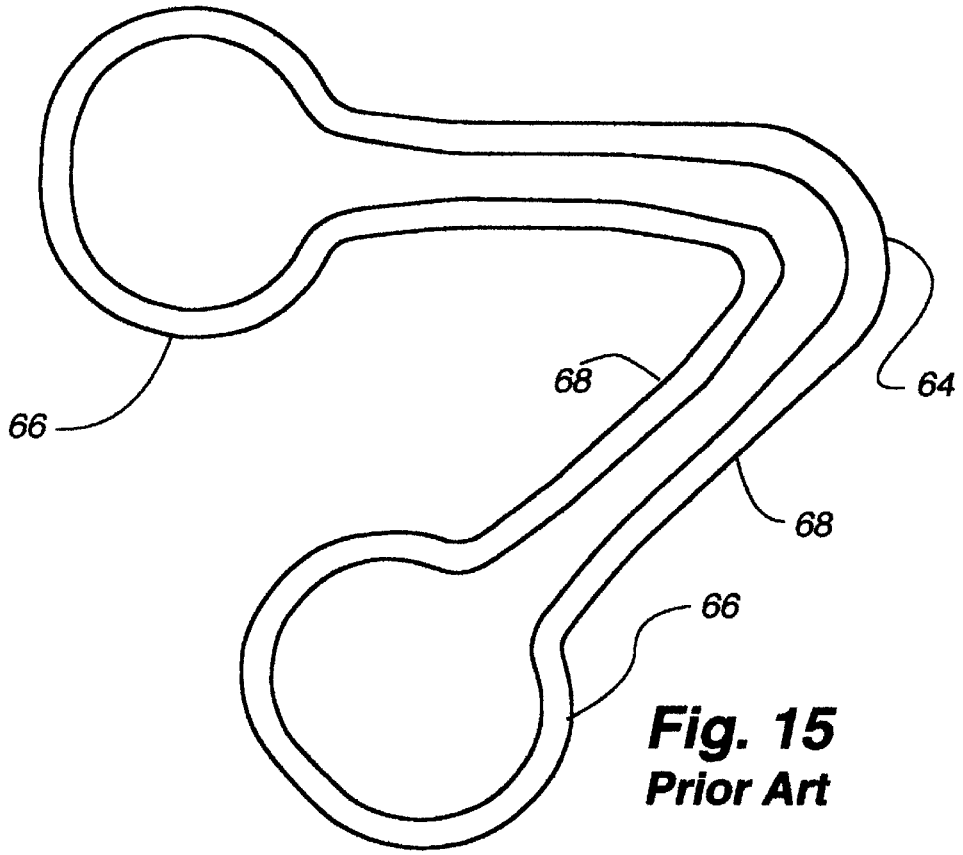
Fig. 15 Prior Art
FIG. 15 is a top plan view of a complicated loop of the prior art.

A further application of the present invention, can be found by utilizing just localized broken areas, i.e., in the transmission components of transmission elements. In FIG. 15, a conventional unbroken transmission element 64 is illustrated. Transmission element 64 has a pair of loops 66 interconnected by a pair of transmission lines 68. Preferably, a plurality of like transmission elements will be spaced circumferentially about a paperboard blank designed to carry a specific food product. The loops 66 can be located such that upon folding of the paperboard blank, the loops will be positioned on the sidewall of the resulting folded carton and the transmission lines 68 extend across the base of the carton. However for other applications, for instance pizza boxes, the paperboard blank will remain flat.

Figure 16:
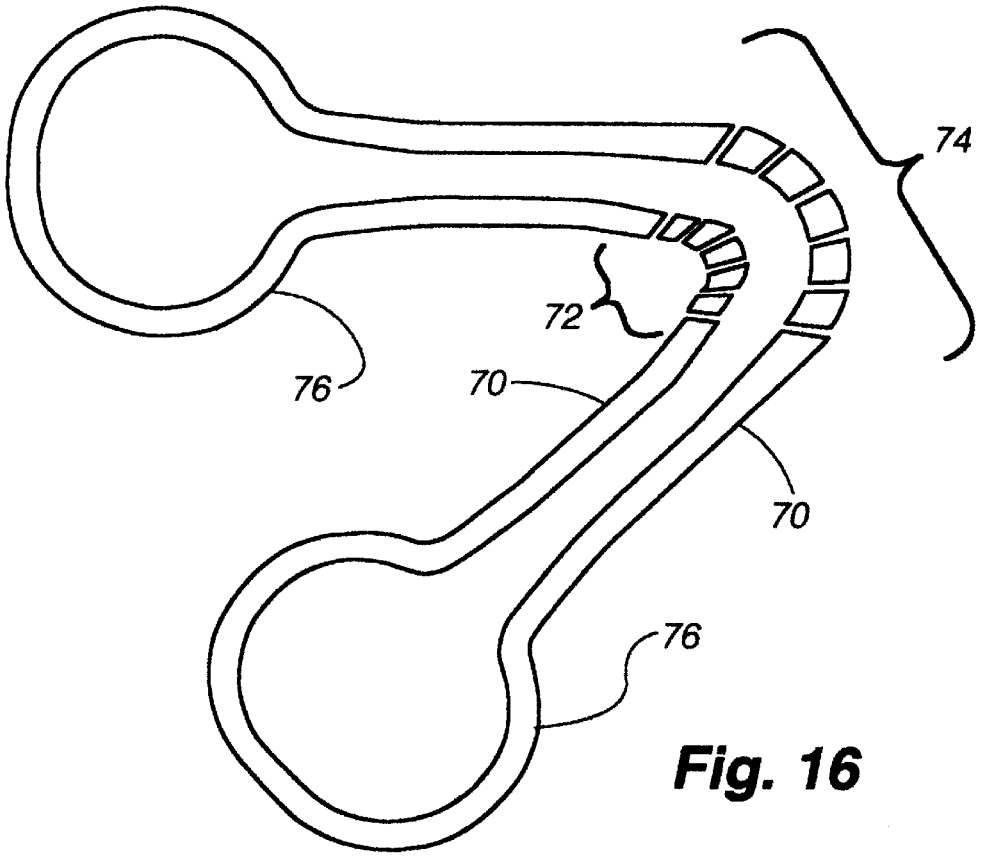
FIG. 16 is a top plan view of a fourth embodiment of the broken loop of the present invention.

In FIG. 16, the heating element has a continuous portion comprising transmission lines 70 and loops 76. The transmission lines 70 have a localized discontinuous portion comprising elements 72 and 74. In the presence of an absorbing load, a decaying voltage would be experienced along the transmission lines 70. This implies that towards the centre of the transmission component the microwave currents would be small or non existent. Therefore breaking the loop at that point would not in any way disturb the microwave performance in conjunction with the food load. However if the loop is not broken, the absence of the food load would cause the transmission component and the two loops 76 to form one large loop. This loop may indeed be close to resonance, fundamental or harmonic, and could cause substrate damage. The insertion of a break in the centre does not in any way affect the functionality of the design, but would render it safe under no load conditions.

It is now apparent to a person skilled in the art that numerous combinations and variations of microwave elements may be manufactured using the present invention. However, since many other modifications and purposes of this invention become readily apparent to those skilled in the art upon perusal of the foregoing description, it is to be understood that certain changes in style, amounts and components may be effective without a departure from the spirit of the invention and within the scope of the appended claims.

We claim:

1. A microwave energy heating element comprising a plurality of spaced microwave components generally arranged in a closed loop pattern, each of said microwave components having a non-resonant length, and when in a loaded condition with a load for capacitively coupling said microwave components together, said microwave components cooperatively redistribute impinging microwave energy, and when in an unloaded condition, said microwave components act independently remaining inert to impinging microwave energy.

2. A microwave energy heating element as claimed in claim 1 wherein said microwave components are arranged in an end to end relation.

3. A microwave energy heating element as claimed in claim 2 wherein said microwave components are identical to each other and are regularly spaced.

4. A microwave energy heating element as claimed in claim 3 wherein said microwave components each has a tab at one end and a slot at an opposite end, said tab sized to fit within a slot of an adjacent microwave component.

5. A microwave energy heating element as claimed in claim 3 wherein said microwave components are arranged in an inner loop pattern and an outer loop pattern concentric with said inner loop pattern.

6. A microwave energy heating element as claimed in claim 5 wherein said microwave components of said inner loop pattern are staggered relative to said microwave elements of said outer loop pattern.

7. A microwave energy heating element as claimed in claim 1 wherein said closed loop pattern has a circumferential length of one wavelength of said microwave energy.

8. A microwave energy heating element as claimed in claim 1 wherein said heating element is mounted on a substrate having at least one layer of susceptor material associated with one surface thereof.

9. A microwave energy heating element as claimed in claim 8 wherein said substrate is selected from the group consisting of polymeric film, paperboard and paper.

10. A microwave energy heating element as claimed in claim 9 wherein said microwave components are comprised of a metallic film.

11. A sandwich coupon comprising a substrate;

a plurality of spaced microwave components generally arranged in a closed loop pattern on said substrate, each of said microwave components having a non-resonant length, and when in a loaded condition with a load for capacitively coupling said microwave components together, said microwave components cooperatively redistribute impinging microwave energy, and when in an unloaded condition, said microwave components act independently remaining inert to impinging microwave energy.

12. A sandwich coupon as claimed in claim 11 wherein said closed loop pattern has a circumferential length of one wavelength of said microwave energy.

13. A sandwich coupon as claimed in claim 11 wherein said substrate has at least one layer of susceptor material associated with one surface thereof.

14. A sandwich coupon as claimed in claim 13 wherein said substrate is selected from the group consisting of polymeric film, paperboard and paper.

15. A sandwich coupon as claimed in claim 14 wherein said microwave components are comprised of a metallic film.

16. A sandwich coupon as claimed in claim 13 wherein said substrate has a shield layer for protecting an outer edge of said load.

17. A sandwich coupon as claimed in claim 16 wherein said shield layer has an aperture having said plurality of spaced microwave components therein.

18. A sandwich coupon as claimed in claim 17 wherein said aperture is elongated and has said plurality of spaced microwave components arranged in a plurality of closed loop patterns.

19. A microwave energy heating element comprising a continuous portion having a non-resonant length and a discontinuous portion comprising a plurality of spaced microwave components, each of said microwave components having a non-resonant length, when said heating element is in a loaded condition with a load for capacitively coupling said continuous portion and said discontinuous portion together, said heating element cooperatively redistributes impinging microwave energy, and when in an unloaded condition, said continuous and discontinuous portions act independently remaining inert to impinging microwave energy.

20. A microwave energy heating element as claimed in claim 19 wherein said continuous portion includes a resonant loop section and transmission lines extending therefrom.

21. A microwave energy heating element as claimed in claim 20 wherein said discontinuous portion couples said transmission lines together to present a closed loop pattern.

22. A microwave energy heating element as claimed in claim 21 wherein said heating element is mounted on a substrate having at least one layer of susceptor material associated with one surface thereof.

23. A microwave energy heating element as claimed in claim 22 wherein said substrate is selected from the group consisting of polymeric film, paperboard and paper.

24. A microwave energy heating element as claimed in claim 23 wherein said microwave components are comprised of a metallic film.

* * * * *